United States Patent [19]

Batréau

[11] 4,237,999

[45] Dec. 9, 1980

[54] AUTOMATIC ANTI-TILT DEVICE FOR SCAFFOLDINGS

[75] Inventor: Bernard Batréau, Pontault Combault, France

[73] Assignee: Tractel, S.A., France

[21] Appl. No.: 46,087

[22] Filed: Jun. 6, 1979

[30] Foreign Application Priority Data

Jun. 9, 1978 [FR] France ..... 78 17338

[51] Int. Cl.[3] ..... B66D 1/54; B66F 11/04; E04G 3/10; E04G 21/32

[52] U.S. Cl. ..... 182/19; 182/112; 182/142; 182/234

[58] Field of Search ..... 182/112, 113, 144, 142, 182/222, 143, 19; 254/157

[56] References Cited

U.S. PATENT DOCUMENTS

| | | | |
|---|---|---|---|
| 2,436,813 | 3/1948 | Lackner | 182/112 |
| 2,662,734 | 12/1953 | Allenbaugh | 182/112 |
| 3,586,125 | 6/1971 | Durand | 182/112 |
| 3,797,608 | 3/1974 | Virdis | 182/112 |
| 4,106,753 | 8/1978 | Cavalieri et al. | 254/157 |

*Primary Examiner*—Reinaldo P. Machado
*Attorney, Agent, or Firm*—William A. Drucker

[57] ABSTRACT

This device is associated with a scaffolding suspended from at least two winches and is adapted to automatically control a safety mechanism when the scaffolding is inclined beyond a predetermined limit angle to the horizontal. The scaffolding is pivoted at each end to a stirrup rigid with the safety device which is suspended to the hoisting cable through a link. A push-member rigid with the scaffolding engages, when the scaffolding is inclined, a connecting rod which actuates a lever for clamping the jaws on a safety cable passing through the safety device.

11 Claims, 7 Drawing Figures

AUTOMATIC ANTI-TILT DEVICE FOR SCAFFOLDINGS

BACKGROUND OF THE INVENTION

1. Field of the Invention

The present invention is directed to improve and complete the safety of operation of manually or electrically operated scaffolding winches disposed on suspended scaffoldings for raising or lowering the latter. This invention is applicable notably to scaffoldings, nacelles or similar structures or a portion thereof, of the type suspended from at least two winches secured either to the stirrups of the scaffolding or to an overhead outrigger or cornice hook.

In this case, the winding or unwinding speed of the cable of one of the winches may be greater than that of the other winch, thus causing the scaffolding or like nacelle to cant with respect to the horizontal.

Under these conditions, it is highly desirable to provide some automatic intervention means capable of stopping this canting movement, more particularly in the case of an operation or an accidental coming down occurence.

2. Description of the Prior Art

A device of this character, capable of stopping electric winches, is already known in the art. It consists of a tube disposed horizontally when the scaffolding is in its normal horizontal position, and contains mercury. Since the mercury contained in the tube preserves a horizontal surface irrespective of the tube inclination, the desired result is obtained by means of contacts properly arranged in the tube and connected to electric circuit means controlling the starting and stopping of the winch motors. Now this device is objectionable in that it is applicable only to motorized winches, and is relatively fragile and may even operate untimely as a consequence of jolts produced on the scaffolding.

SUMMARY OF THE INVENTION

It is the primary object of the present invention to provide an automatic intervention mechanical device which is at the same time sturdy, reliable and simple to construct and operate: this device is intended:

(1) In the case of manual or motor-driven winches, for controlling a load take-over device, capable of transferring the load to a safety cable disposed adjacent one of the winches when a predetermined minimum angle of tilt of the scaffolding appears between the ends thereof, in relation to the horizontal.

(2) In the case of electric winches, independently and in a manner linked to the above-mentioned intervention, preliminarily, simultaneously or subsequently to this intervention, for controlling means for stopping the motor of one or each of the winches when a predetermined minimal angle of tilt occurs between the scaffolding ends, in relation to the horizontal.

The function of this intervention device is to record, directly or indirectly, the angle from the floor to the vertical direction for actuating either a load take-over device or a motor stopping device, or a combination thereof.

The basic principle of this invention is to use a connecting rod having one end pivoted or rigidly secured to a member of the controlled device, and so arranged that the other end receives a push or pull impulse from a floor element of the scaffolding when the scaffolding pivots about the pivot axis provided between the scaffolding and the stirrup on which the controlled device is mounted.

This connecting rod is adapted to cooperate with a load take-over device, which may be completed by a device for stopping the winch motor proper, this stop-motion device being responsive in turn to a load take-over device. According to an alternate form of embodiment, the two devices are combined and incorporated into a common casing. This invention is also applicable to such cases wherein, for the sake of simplification, the connecting-rod controls directly and solely the motor stopping device without passing through the load take-over device.

According to the specific features described herein, the concept of the load take-over device is such that it can intervane likewise independently of the connecting device constituting the basic element of the present invention, for example in case of fall or (according to certain operating conditions) when a predetermined speed limit is over-stepped, a condition that might occur similarly at both ends of the scaffolding or nacelle, so that in this case the latter would not cant.

Thus, the device of this invention has multivarious principles and intervention modalities, so that the vertical movements accomplished by the scaffolding or nacelle take place with a high degree of safety.

By way of example, the intervention devices of this invention are mounted on a flying scaffolding or similar system comprising two motor-operated hoisting winches located near the ends of a same scaffolding, wherein each winch is assisted by a load take-over device and by a motor stopping device, the first device controlling the second and being responsive to the intervention device.

DESCRIPTION OF THE PREFERRED EMBODIMENT

Figure 1:
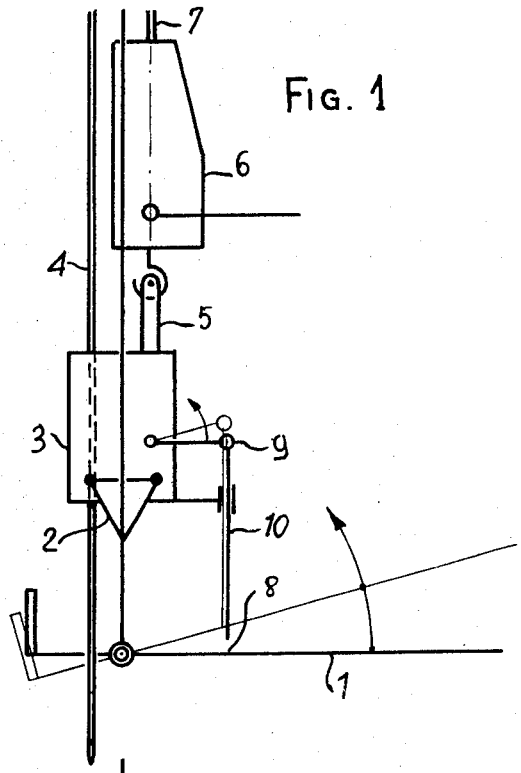
FIGS. 1 to 4 inclusive illustrate diagrammatically various forms of actuation of the automatic safety device of this invention.
Figure 2:
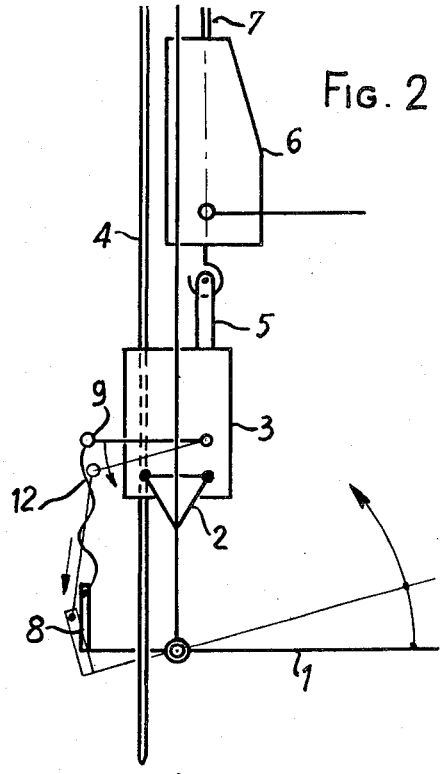

Referring first to the diagrams of FIGS. 1, 2, 3 and 4, the consequences of the scaffolding tilt on the lever controlling the actuation of the safety device of this invention are illustrated therein. More particularly, in FIG. 1 this control lever is responsive to a vertical thrust exerted by a scaffolding element on the connecting member; in FIG. 2, the control lever is responsive to a vertical pull or tractive force exerted by a scaffolding element on the connecting member; in FIGS. 3 and 4, the same control lever is responsive to a lateral thrust exerted by a scaffolding element on the connecting member.

In FIGS. 1 to 4, the reference numeral 1 designates diagrammatically one end of the scaffolding or nacelle suspended by means of a stirrup 2 from a safety device 3 through which the safety cable 4 is caused to pass. This safety device 3 being adapted to firmly grip this cable by clamping jaws according to a well-known general arrangement. The safety device 3 proper is also suspended by means of a link 5 from a carrier apparatus 6 retained by the main load cable 7. A portion or element 8 rigid with the scaffolding or nacelle is adapted to actuate through the medium of a connecting member the lever 9 controlling the safety device.

Figure 3:
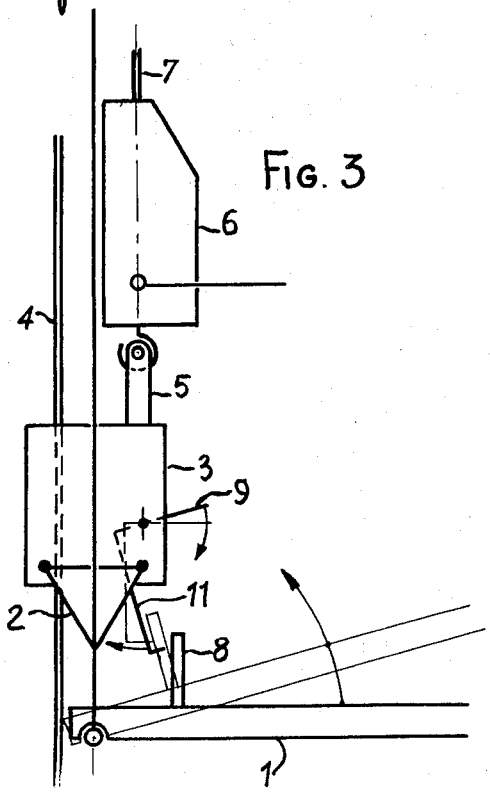
Figure 4:
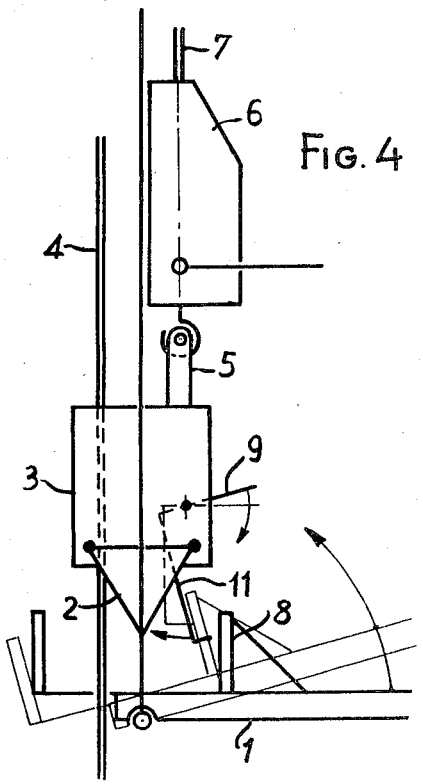

In the case illustrated in FIGS. 1, 3 and 4, the connecting member consists of a rigid member independent of the scaffolding element by which it is adapted to be actuated by thrust action. This rigid member may consist for example of a rod 10 movable for vertical translation and pivotally connected to the lever 9 (FIG. 1), or of a pivoted lever 11 (FIGS. 3 and 4) rigid with control lever 9. In the case illustrated in FIG. 2, the control action is a pulling one and the connecting member is a flexible element 12 having its lower end positively attached to the scaffolding element 8 so as to be actuated thereby by traction, the upper end of this flexible element being connected to the control lever 9. In all cases, the action exerted on the connecting member of the tilting scaffolding is a one-way action.

All the above mentioned forms of embodiment illustrated in FIGS. 1 to 4 to refer to the case wherein the intervention device actuates the safety device passing in a relatively low position in relation to the one located at the opposite end of the scaffolding or nacelle. A modified version in case it would actuate the safety device passing in a relatively high position is also within the scope of this invention and is obtained by inverting the position of the types of connecting member consisting of the rod 10, lever 11 and flexible element 12.

Figure 5:
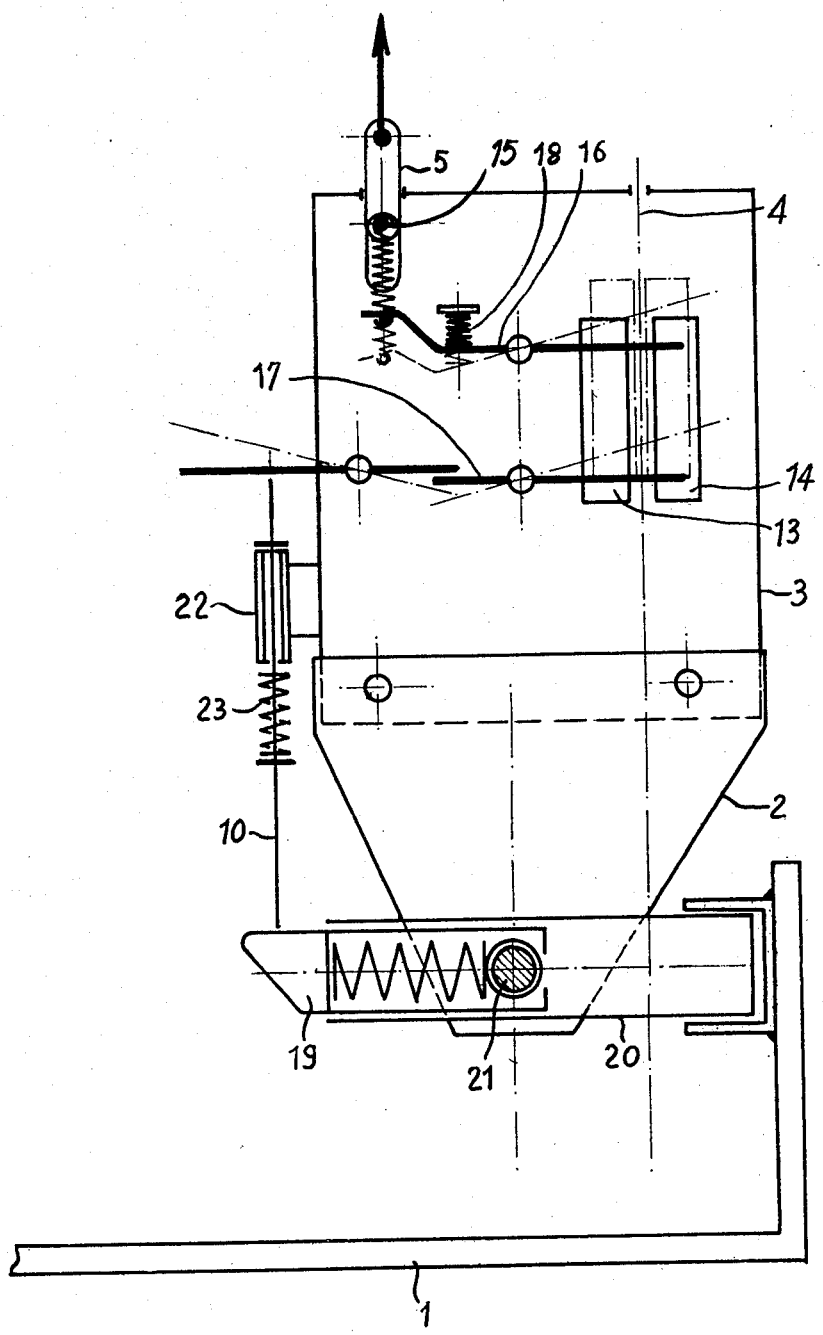
FIG. 5 is a diagrammatic view showing on a larger scale a modified and simplified form of embodiment of the safety device of this invention.

FIG. 5 illustrates the action exerted by the rod 10 in the simplest case of a load safety device 3, however without the motor stopping function. The type of device illustrated in this FIG. 5 is the one in which a pair of jaws 13,14 adapted to clamp a safety cable 4 are held in their open or inoperative position by the load suspended via a device 3 from a fulcrum pin 15 of a suspension link 5 through which the load is retained, as illustrated by the arrow on top of the Figure. The jaws 13,14 are kept open in the position shown in thick lines by their control links 16,17, and the load release enables the compression spring 18 to expand and thus control the links 16,17 in the direction to close the jaws 13,14.

The present invention is also applicable to those cases in which the hoisting winches are attached to outriggers or to a cornice hook at the top of the building or frame structure, as well as to those wherein the winches are secured to stirrups on the scaffolding or nacelle. In the first case the scaffolding or nacelle is secured to the end of each control cable through the medium of the safety device.

The mounting illustrated diagrammatically in FIG. 5 has an additional advantageous feature in that the stirrup 2 to which the safety device 3 is secured can be folded on the floor of the scaffolding or like structure, notably for storage and transport purposes. To this end, and to permit the necessary rotation of stirrup 2 through an angle of about 90° about its pivot axis 21 with respect to the scaffolding structure, the fixed element of the scaffolding which acts as an abutment member to the connecting rod 10 in the case of a push action must be retractable. For this purpose, the abutment member consists of a spring-loaded push member 19 adapted to slide in a socket 20 fulcrumed to the pin 21 of the supporting stirrup 2 and rigidly attached to the corresponding end portion of the scaffolding 1. The contour of the outer end of this push member 19 comprises a flat face such that the connecting rod 10 can position itself automatically during the unfolding operation. This rod 10 is guided by a slidway 22 rigid with the safety device 3 and acting as a reaction member to a spring 23 constantly urging said rod 10 against the push and abutment member 19.

Figure 7:
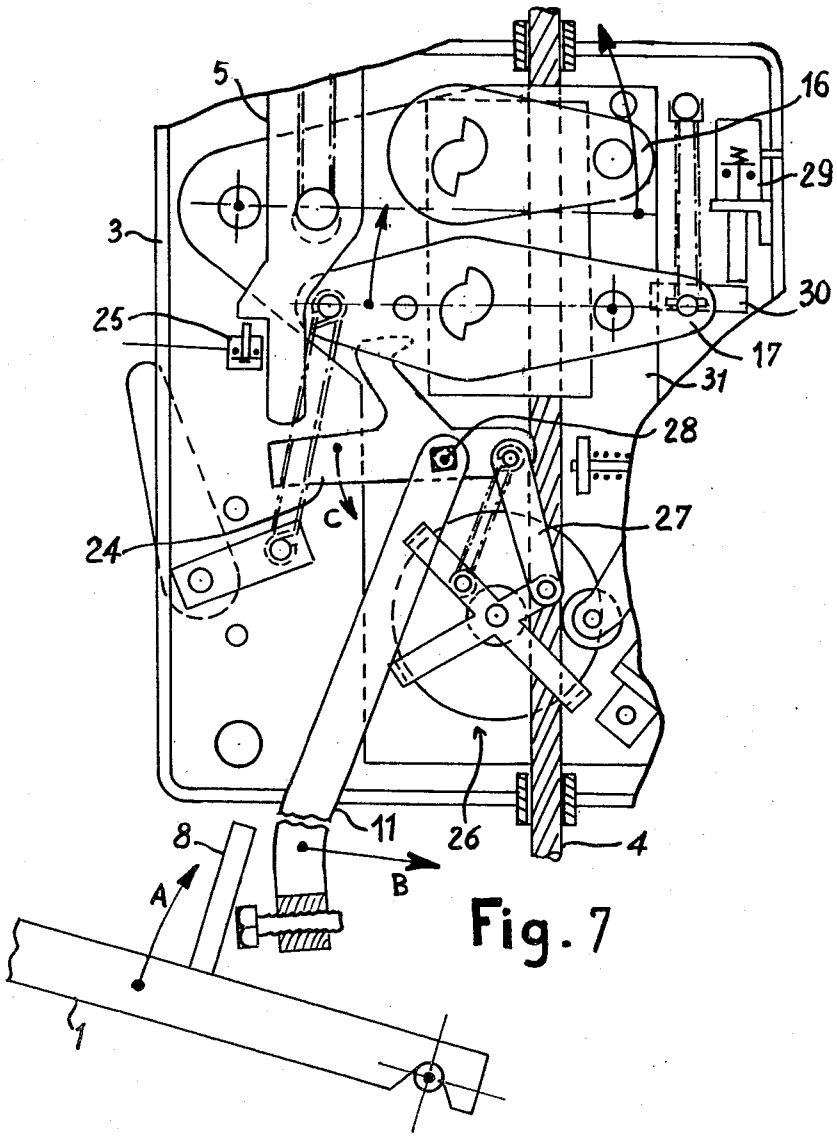
FIGS. 6 and 7 illustrate more in detail another modified form of embodiment of the device in two operative positions.
Figure 6:
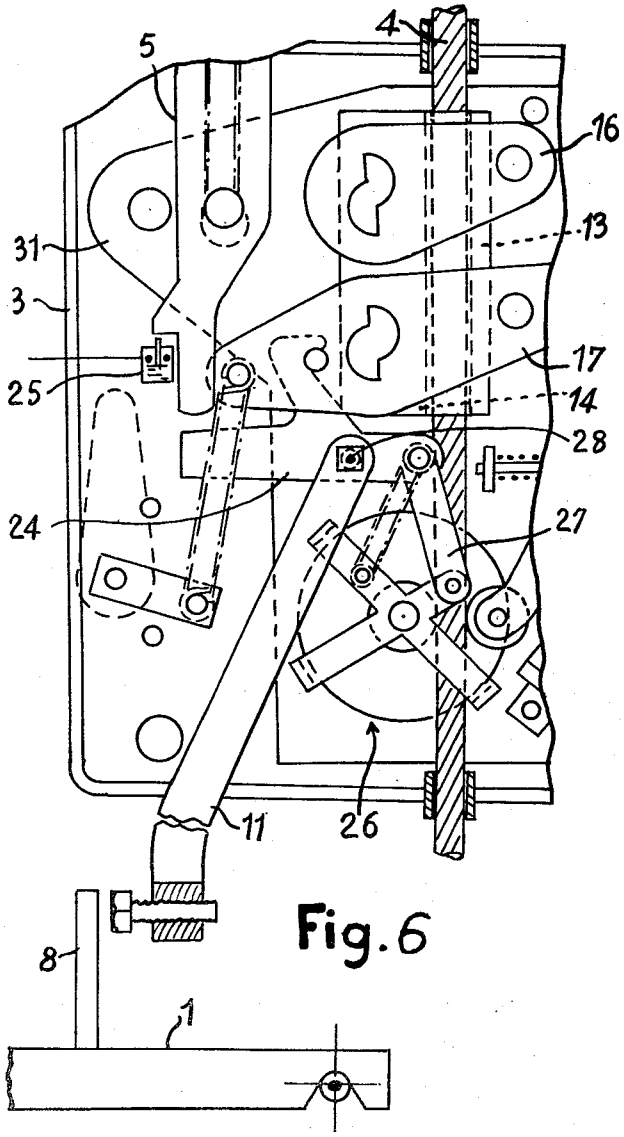

FIGS. 6 and 7 illustrate the action exerted by a pivoting lever 11 on a safety device 3 combining the taking over of the load by means of the safety cable 4 with the stoppage of the hoisting motors and comprising a trigger for releasing the closing action of the jaws according to the provisions of the U.S. Pat. No. 4,106,753.

In the device, the jaws 13,14 through which the safety cable 4 is caused to pass are held in their cable-release or open position against the force of a pre-clamping spring by a trigger 24 engaging one of the jaw control levers 16,17. In case the carrier or load cable becomes slack, for example if the scaffolding 1 is retained by an obstacle during a downward movement thereof, the suspension rod 5 will actuate simultaneously an electric switch 25 for controlling the de-energization and immediate stoppage of the winch motor and engage an extension of trigger 24 for pivoting same and thus control the closing or clamping movement of the jaws on the safety cable. The device further comprises rotary means 26 capable of detecting the linear velocity of the safety cable 4 and connected through a link 27 to the trigger 24 whereby, in case of excessive speed or when a predetermined or threshold cable velocity is reached, the trigger 24 is pivoted to release the jaws 13,14 which will thus tightly clamp the cable 4.

According to this invention, the lever 11 having its lower end adapted to be engaged by the element 8 of the scaffolding or like structure 1 when the latter has been tilted to a predetermined degree, has its upper end rigidly connected to the trigger 24 at the level of the pivot pin 27 thereof. Therefore, when the scaffolding or nacelle 1 is inclined in the direction of the arrow A in FIG. 7, the element 8 thereof will move the lever 11 in the direction of the arrow B, thus rotating the trigger 24 about its pivot pin 28 in the direction of the arrow C to release the jaws 13,14 to their cable camping position.

It will be seen that, according to the known practice, an electric switch 29 connected to the electric motor of the winch is carried by the casing of the safety device and adapted to register with a stud 30 rigid with the pivoting frame 31 supporting the jaws 13,14 so that, in case the latter were caused to clamp the safety cable 4, the frame 31 will pivot automatically and thus cause the stud 30 rigid therewith to actuate the switch 29 and stop the winch motor. It is clear that, under these conditions, the device of this invention, by actuating the connecting lever 11 in case of abnormal tilting movement of the scaffolding or like structure, and by actuating likewise the trigger 24 to close the jaws 13,14, will actuate automatically the electric switch 29.

It will be readily understood by those conversant with the art that the above description is given by way of illustration, not of limitation, since constructional additions and/or modifications may be brought thereto without departing from the basic principles of the invention as described in the attached claims. More particularly, it will be understood that any suitable coupling means may be provided between the connecting lever and an electric switch carried by the casing of the safety device for actuating this switch directly (and thus stop the motor or motors of the system) during the movement of this lever as a consequence of an abnormal tilting of the scaffolding or like structure.

What I claim is:

1. In a scaffolding or like structure suspended by means of bearer cables from two or more winches, an automatic intervention device for stopping a tilting movement of said scaffolding which comprises:

a safety device suspended from at least one of said bearer cables, a safety cable parallel to said bearer cables and passing through said safety device, a stirrup fixed to said safety device and to which is pivoted said scaffolding in such a manner than said stirrup keeps a vertical position irrespective of the scaffolding inclination, a control lever pivoted to the safety device and adapted, when actuated, to grip said safety device on said safety cable, and a connecting member having one end fixed to said control lever and having its opposite end adapted to be actuated by the scaffolding, in case of a tilting of this scaffolding exceeding a predetermined angle, for actuating in turn said control lever and causing the safety device to grip the safety cable.

2. In a scaffolding or like structure suspended by means of bearer cables from two or more winches, an automatic intervention device according to claim 1, wherein said connecting member consists of a rod rigidly fixed at one end to the control lever of the safety device, disposed vertically with relation to the floor of the scaffolding, passing through a guide member of the safety device and having its opposite end disposed at a predetermined distance from the scaffolding, so that when the scaffolding tilts of a predetermined angle said scaffolding engages said opposite end of the rod and causes this rod to slide vertically through said guide member to actuate the control member of the safety device.

3. In a scaffolding or like structure suspended by means of bearer cables from two or more winches, an automatic intervention device according to claim 1 wherein said safety device comprises a pair of jaws which are normally maintained in open position and are adapted to clamp said safety cable when the control member of the safety device is actuated.

4. In a scaffolding or like structure suspended by means of bearer cables from two or more winches, an automatic intervention device according to claim 3 wherein said jaws comprise pivoting control links which are connected to a suspension link of said safety device to maintain the jaws open under the action of the scaffolding weight when this scaffolding is in an horizontal position, while these control links are adapted to be engaged by the control lever of the safety device and pivoted in a direction causing the clamping of the jaws when this control lever is actuated by the connecting member.

5. In a scaffolding or like structure suspended by means of bearer cables from two or more winches, an automatic intervention device according to claim 3 wherein a trigger retains said jaws in open position while the connecting member is adapted to engage said trigger for releasing and closing the jaws when the scaffolding has tilted of a predetermined angle.

6. In a scaffolding or like structure suspended by means of bearer cables from two or more winches, an automatic intervention device according to claim 4 wherein said suspension link presents a projection adapted to engage an electric switch controlling the de-energization of the electric motor of the winch associated to the bearer cable when the jaws of the safety device clamp the safety cable.

7. In a scaffolding or like structure suspended by means of bearer cables from two or more winches in automatic intervention device according to claim 1 wherein said connecting member is adapted to actuate a component member of said safety device for stopping the operation at least of the motor of the winch associated to the bearer cable to which said safety device is coupled.

8. In a scaffolding or like structure suspended by means of bearer cables from two or more winches, an automatic intervention device according to claim 2 wherein said connecting rod is so disposed as to receive and transmit a thrust from a point rigid with the scaffolding floor which is other than the pivotal point of connection thereof with said stirrup, when said first-named point moves to a point symmetrical thereto, located at a lower lever with respect to the vertical transverse plane passing through the centre of the scaffolding.

9. In a scaffolding or like structure suspended by means of bearer cables from two or more winches, an automatic intervention device according to claim 8 wherein said connecting rod is urged by spring means for constant engagement with said fixed point rigid with the scaffolding floor.

10. In a scaffolding or like structure suspended by means of bearer cables from two or more winches, an automatic intervention device according to claim 9 wherein said point rigid with the scaffolding floor and adapted to act as a stop to said connecting rod is a push member held in an intervention position by spring means and retractable in a transverse direction with respect to said connecting rod so that the stirrup to which the safety device is secured can be retracted.

11. In a scaffolding or like structure suspended by means of bearer cables from two or more winches, an automatic intervention device according to claim 1 wherein said connecting member consists of a flexible linkage secured at one end to the scaffolding and at the other end to the control member of the safety device.

* * * * *